United States Patent [19]

Card et al.

[11] Patent Number: 4,608,934

[45] Date of Patent: Sep. 2, 1986

[54] KNIFE HOLDER ASSEMBLY FOR A CUT PILE TUFTING MACHINE AND PROCESS OF ASSEMBLING THE SAME

[76] Inventors: Roy T. Card, 4012 Creekwood Ter., Chattanooga, Tenn. 37421; Joseph L. Card, 1515 Edgewood Cir., Chattanooga, Tenn. 37405

[21] Appl. No.: 639,144

[22] Filed: Aug. 9, 1984

Related U.S. Application Data

[63] Continuation-in-part of Ser. No. 508,853, Jun. 29, 1983.

[51] Int. Cl.[4] ..... D05C 15/00

[52] U.S. Cl. ..... 112/80.60

[58] Field of Search ..... 112/79

[56] References Cited

U.S. PATENT DOCUMENTS

| | | | |
|---|---|---|---|
| 3,604,379 | 9/1971 | Cobble | 112/79 R |
| 3,757,709 | 9/1973 | Cobble | 112/79 R |
| 4,207,825 | 6/1980 | Bleasdale | 112/79 R |
| 4,445,446 | 5/1984 | Beasley | 112/79 R |

*Primary Examiner*—Ronald Feldbaum

*Attorney, Agent, or Firm*—Newton, Hopkins & Ormsby

[57] ABSTRACT

A group of knives for a cut pile tufting machine are preassembled in a knife holder carried by a bracket, as the bracket is held in a jig. The bracket is then removed from the jig and inserted into one of a plurality of transverse parallel angling slots in a carrier member of the machine, the knives and bracket being moved in a linear path until a stop on the bracket engages the carrier member to indicate that the knives are in proper position for cutting action with respect to their loopers.

12 Claims, 16 Drawing Figures

KNIFE HOLDER ASSEMBLY FOR A CUT PILE TUFTING MACHINE AND PROCESS OF ASSEMBLING THE SAME

CROSS REFERENCE TO RELATED APPLICATIONS

This is a continuation-in-part of our copending application Ser. No. 508,853, filed June 29, 1983 entitled KNIFE HOLDER FOR TUFTING MACHINE.

BACKGROUND OF THE INVENTION

1. Field of the Invention

This invention relates to a cut pile tufting machine and is more particularly concerned with a knife holder assembly for a cut pile tufting machine and process of assembling and installing the same in the tufting machine.

2. Background of the Invention

In the past, cut pile tufting machines have been extensively used for producing fabric, having tufts which are cut at their outer extremities. Such prior art machines usually contain individually installed knives arranged in groups of four which are carried by a knife block. These knife blocks are mounted in succession on a transversely extending knife block support bar which is rocked back and forth by a knife drive shaft. Each prior art knife block consists of inner and outer portions within which are formed opposed pairs of channel-shaped slots, the slots receiving the edges of the knives so as to mount the knives in space parallel relationship. Set screws lock the knives in place. The inner and outer portions of the knife block are joined by a central web, which can be bent, in the event that the set screws on one side of the web are tightened to a greater extent than the set screws on the other side of the web. The inner portion of the knife block is provided with a stub shaft which protrudes outwardly therefrom so as to be received in a cylindrical hole in the knife block support bar, there being provided a set screw which locks the cylindrical mounting shaft in place. When this set screw becomes loose or the mounting shaft becomes scored, there is a tendency of the knife block to rotate and thereby loosen the tension which is applied by the upper edge portion of the knives against their respective loopers. This may cause the loops of yarn sewn by the tufting machine to hang up on the loopers.

SUMMARY OF THE INVENTION

Briefly described, the present invention includes a knife block assembly which is substituted for the conventinal knife block and knives of a cut pile tufting machine. Specifically, the knife block assembly of the present invention is installed on a conventional tranversely extending knife block support bar and includes a plurality of mounting bracket carrying members mounted in juxtaposition, i.e., end-to-end, throughout the transverse length of the conventional knife block support bars. Each mounting bracket carrying member has a plurality of parallel, spaced, opposed pairs of mounting brackets receiving guides which angle upwardly at acute angles to the member, as part of or on the outer or front side of the member. The pair of guides respectively slidably receive and retain in fixed angular positions and, in equally spaced relationship, the mounting brackets for the knives, each of which extends transversely upwardly to terminate above the carrying member. When being installed, each bracket is moved along a linear path, generally upwardly toward the loopers. On the upper end of each bracket is a knife holder.

Each knife holder, in cross-section, is a hollow, square or parallelepiped tubular member provided at its upper and lower edges with parallel slots angling at about 4° to the transverse axis of the block. These parallel slots receive the conventional knives, in spaced parallel relationship, so that they are offset to and protrude upwardly, with their edges generally parallel to the bracket, and are inserted between their respective loopers as their bracket is moved in its linear path. Clamps, held by set screws, clamp the knives in place on the knife holder.

A plurality of such brackets, with their respective knife holders and knives, are thus disposed side-by-side, extending transversely across the machine. Each knife is held parallel to its next adjacent knife and all extend upwardly so that each knife is arranged at a compound angle inclined at a transverse acute angle of about 82° from the horizontal (8° from the vertical) and canted at about 4° from the plane of its associated looper for scissors action. The cutting edge portion of each knife, when in place, is yieldably biased or urged into engagement with the side of its associated looper by its holder.

Separate from the tufting machine is a jig for aligning the upper ends of each group of knives in a single knife holder. This jig has a mounting bracket cradle in one end and an upstanding knife stop, a fixed distance from the cradle on a common base. The mounting bracket is slidably inserted and is moved, in a linear path toward the stop and into the cradle until its arresting pin strikes the cradle which holds it in a fixed position. Then, the the knives are inserted in slots in the knife holder held by the bracket until each knife strikes the knife stop. The knives are then locked in place.

The knife carriage thus formed, i.e., the bracket and bracket holder, with the knives is, thereafter, removed from the jig and transferred to the tufting machine where the bracket is inserted in a linear path onto the carrier member, the knives being flexed with a knife tension tool as the approach their loopers, installed. The knife tension tool tension tool has a handle and a head with sidewise opening slots for receiving the edges of the knives. Manipulation of the handle flexes all blades simultaneously so that they are held free of the loopers until the mounting bracket is essentially fully received by the member and upward movement is arrested by the arresting pin.

A knife removal tool has a handle with a pair of tines projecting sidewise from the end of the handle. This handle is used to spread the knives apart so that access can be had to the detent which locks the bracket to the carrier member.

Accordingly, it is an object of the present invention to provide a knife holder assembly for tufting machine which can be installed as a unit containing preset knives on a conventional cut pile tufting machine so that all knives in the machine are at essentially the same height and have essentially the same biasing against the side of their associated loopers.

Another object of the present invention is to provide an apparatus and process by which a plurality of knives can be simultaneously installed and removed from a tufting machine.

Another object of the present invention is to provide a knife holder assembly and process by which a plurality of knives can be readily assembled and installed in a tufting machine without measurement or judgment as to the height of the knives.

Another object of the present invention is to provide an apparatus and process by which a group of knives be readily and easily replaced in a tufting machine, without disturbing the mounting of the adjacent loopers.

Another object of the present invention is to provide a knife holder assembly for a cut pile tufting machine which will hold the blades or knives at preset angles which do not vary.

Another object of the present invention is to provide a knife holder assembly for a cut pile tufting machine which will assure that equal preset tensions are respectively applied to the knives of the holder assembly.

Another object of the present invention is to provide a knife holder assembly for a cut pile tufting machine which is inexpensive to manufacture, durable in structure and efficient in operation.

Another object of the present invention is to provide a knife holder assembly for a cut pile tufting machine which requires no manual setting of the angle of the knives and in which all knives wear substantially uniformly across the machine.

Another object of the present invention is to provide a knife block assembly which is capable of holding a larger number of knives than the prior art knife block.

Another object of the present invention is to provide a knife block assembly which does not warp when tension is applied to the set screws which lock the knives in place in the assembly.

Another object of the present invention is to provide a knife block assembly for cut pile tufting machine which will support each knife therein at spaced locations and on all four sides of the knife.

Another object of the present invention is to provide a knife block assembly which has webs between each of the knives so as to space the knives positively and so as to give support to each knife and prevent pivoting of the outer portion of the block when the set screw is tightened or pressure is put on the knife.

Another object of the present invention is to provide a knife block assembly which will hold a group of knives uniformly and insert them simultaneously in a prescribed parallel, linear, path into positions against their loopers.

Another object of the present invention is to provide a knife block assembly which will hold the knives at an optimum compound angles with respect to the planes of their respective loopers.

Other objects, features and advantages of the present invention will become apparent from the following description when taken in conjunction with the accompanying drawing wherein like characters of reference designate corresponding parts thoughout the several views.

Figure 1:
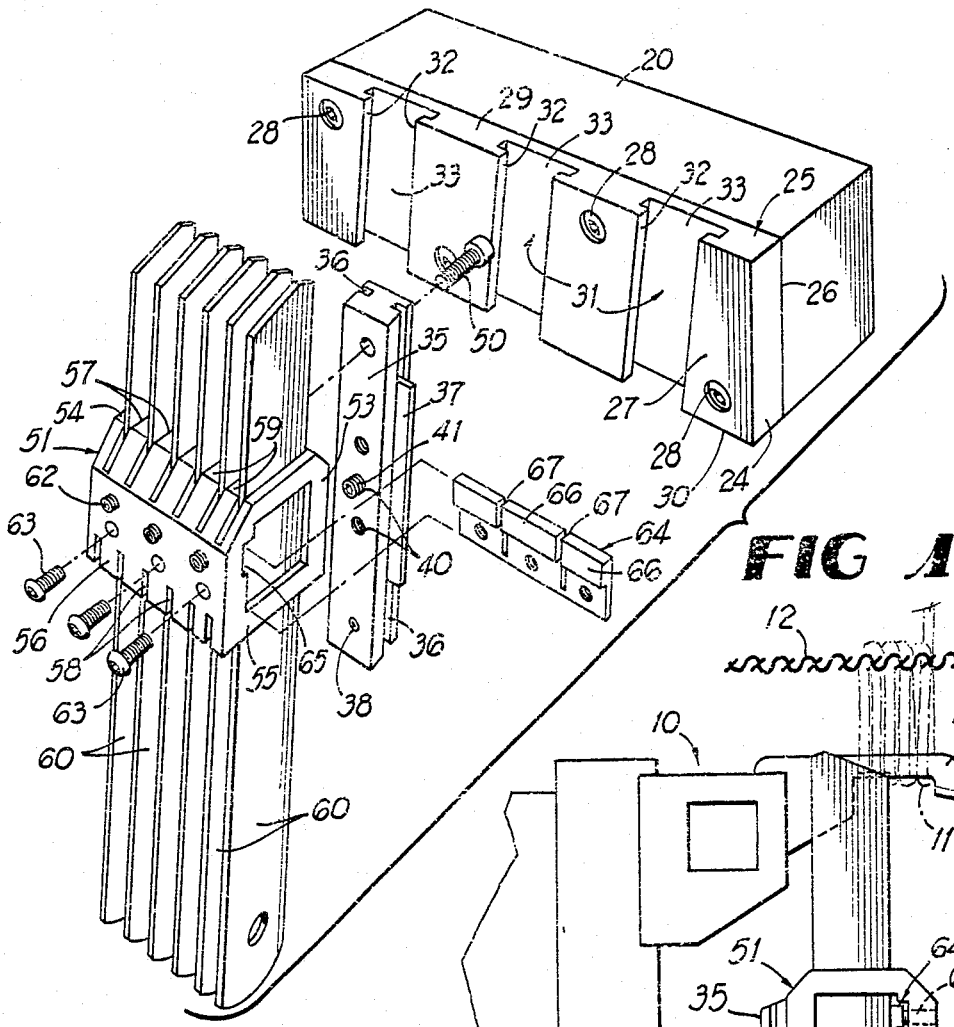

DESCRIPTION OF THE PREFERRED EMBODIMENT:

Referring now in detail to the embodiments chosen for the purpose of illustrating the present invention, numeral 10 in FIG. 1 denotes generally a cut pile tufting machine which has the usual structure for inserting loops 11 of yarn into a backing material and has conventional juxtaposed loopers 22 which catch and retain, for cutting, these loops 11. The needles, needle bar, looper drive shaft, and links for moving the needles, loopers and knives, are so conventional that these mechanism have been deleted for clarity. They are identical to those shown in my co-pending application Ser. No. 508,853. Suffice it to state that the cut pile loopers or looper hooks 22 are carried in side-by-side, parallel relationship to each other by a mounting block 23, these cut pile loopers 22 being staggered and evenly spaced transversely across machine 10 and beneath the path of travel of the backing material 12 so as to engage, respectively, yarn loops 11 carried by the needles (not shown), when the needles have inserted them-through the backing material 12 to about maximum depth. The cut pile loopers 22 are vertically disposed, extend longitudinally surface of the support bars 20. Each carrying member 25 has a flat, rectangular, rear surface 26 and a flat, rectangular front surface 27 parallel to the rear surface 26. Staggered bolts 28, the heads of which are recessed in the front surface 27 mount the carrying members such as member 25 on the support bars 20 and beneath loopers 22 so that the rear surface 26 is flush against the front surface of the block 20. The ends 24 of the member 25 are flat, for abutting the next adjacent member 25. Member 25 also has parallel horizontal upper and lower surfaces 29 and 30.

Figure 2:
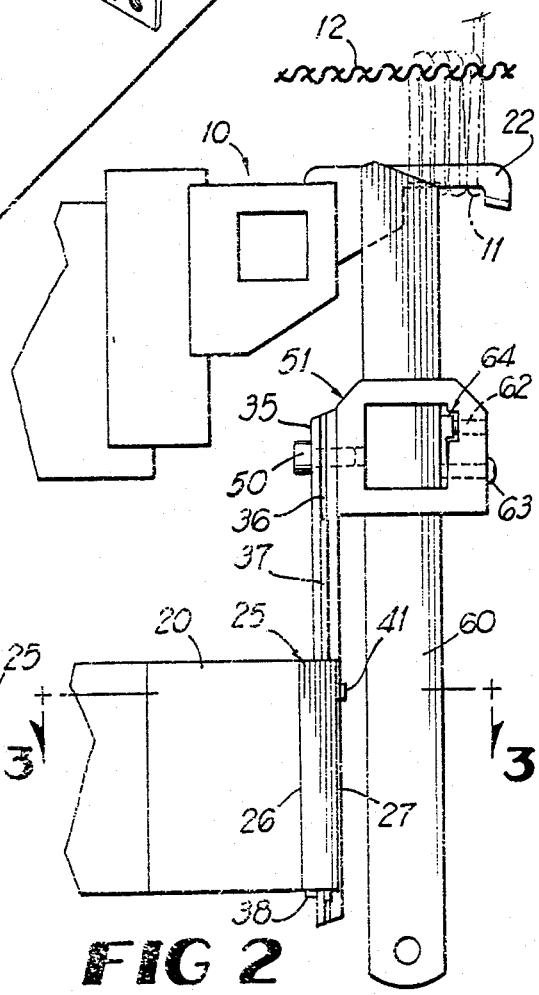
Figure 3:
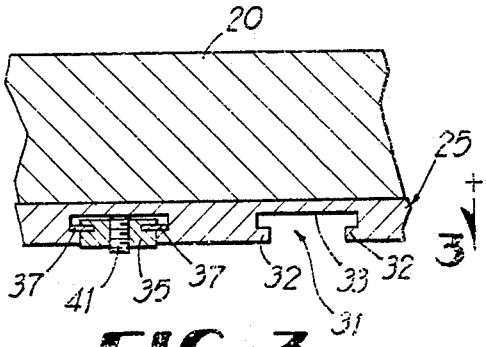

In the embodiment of FIGS. 1, 2, and 3, each carrying member 25 is milled out at acute angles, each between about 79° and about 85° and preferably about 82° from the transverse or horizontal plane of the axis of member 25 (11° to 5° and preferably 8° from the vertical. This provides a plurality of forwardly, opening, equally spaced, angled, parallel, linear, T-shaped recesses or slots 31 throughout the height of the member 25. Usually, carrying member 25 has four such slots 31. Since the slots 31 are T-shaped, each is defined at its front by spaced, pairs of straight, parallel, transversely aligned, inwardly protruding guides or flanges 32 and at the rear of the slot 31 a flat back surface 33 spaced inwardly from and parallel to the guides 32. Slots 31 are also open along upper and lower surfaces 29 and 30.

The slots 31 respectively receive and retain. upstanding mounting brackets, such as bracket 35, of a knife carriage seen best in FIG. 1. In the present embodiment bracket 35 is a piece of bar stock forming an elongated right prism, the opposite sides of which are provided respectively with opposed outwardly opening lug receiving slots 36, within which are pressed the flat thin rectangular blades or lugs 37. Lugs 37 protrude outwardly out of the sides of bracket 35, the dimensions of the bracket 35 being such that the lugs 35 respectively slide behind the opposed guides 32 as the bracket 35 is inserted in an upward direction into slot 31. The width of bracket 35 is about equal to the distance between the guides 32 so that the bracket is guided in a linear path as it is progressively inserted upwardly or is removed downwardly. The bracket 35 then will not tilt after it is received or partially received in slot 31.

At the bottom portion of the bracket 35 is fixed a rearwardly protruding cylindrical arresting member or pin 38 which acts as a stop to arrest upward movement of the bracket 35, when the bracket 35 is inserted fully upwardly in slot 31 to a prescribed position, the pin 38 coming to rest against bottom 30 of bracket carrying member 25.

In the central portion of bracket 35 are a plurality of vertically spaced, internally threaded holes 40, which selectively receive a set screw 41 therein, the set screw 41 engaging back surface 33 when it is tightened. This screw forms a detent which locks the bracket 35 at its prescribed or predetermined appropriate position or height in the slot 31.

The upper end portion of the bracket 35 extends above member 25 and is provided with a hole through which a bolt 50 projects, the bolts 50 being threadedly received in a square or rectangular knife holder 51. The knife holder 51 thus offset from bracket 35 and extends forwardly of the bracket 35 and transversely across the upper portion of the flat front surface of the bracket 35 so that the upstanding rear plate 53 of the knife holder 51 is held flat against the upper surface portion of the bracket 35. A locating pin 42, spaced from bolt 50, protrudes from the bracket 35 into a hole in holder 51 to prevent rotation of holder 51 about bolt 50.

The knife holder 51 is a transversely disposed hollow, tubular, rectangualr member, having an upper plate 54 and a lower plate 55 is spaced generally horizontal parallel relationship. These plates 54 and 55 protrude from the upper and lower edges respectively of the back plate 53. The outer end portions of the upper and lower plates 54 and 55 are joined by front plate 56 which is disposed parallel to and spaced from back plate 53. The inside width of the knife holder 51 from the front surface of plate 53 to the rear surface of plate 56 is approximately equal to or slightly wider than the width of a knife or blade 60.

The upper plate 54 of the knife holder 51 is provided with a plurality of evenly spaced parallel, closed, upper knife receiving slots 57. The slots 57 are equally spaced and parallel to each other. The slots are also parallel to the ends of the knife holder 51, being arranged at an acute angle of about 4° from the planes of the looper 22 so that the front of the cutting edge 60 is angled toward the looper 22 for a scissors action. While a 4° angle is preferable, the angling of the knife 60 can range up to about 11°. Each upper slot 57 has an opening which is only slightly larger than the dimensions of the knife 60 which it receives. The knives 60 are much longer than the height of the holder 51. Thus, when the knife 60 is inserted through the slots 57 and 58, an increment of the blade 60 is firmly held being confined against appreciable movement longitudinally and transversely by the block 51. The webs 59 between the slots 57 evenly space the knives or blades 60 apart.

The lower slots 58 are aligned with their cooperating slots 57 so that a knife 60, passing through a lower slot 57 will be guided into an upper slot 58. In such an arrangement, each blade 60 protrudes outwardly in both directions, extending upward above bracket 35 and downwardly over the front of bracket 35 and are in side-by-side relationship. Thus they extend upwardly with their edges parallel and offset from the bracket 35. A central increment of each knife 60 is confined by the holder 51. The central webs between slots 58 evenly space the knives 60, apart.

The inside surface of the front plate 56, below plate 54 is provided with a U-shaped transverse inwardly opening recess 65 for receiving therein a rectangular transversely knife detent or clamp 64. The clamp 64 is of a width slightly less than the distance between upper place 54 and lower plate 55 and of about the same transverse length as the knife holder 51. It has spaced, parallel, upwardly opening slots 67 which separate the clamp 64 into juxtaposed, separately flexible clamp elements for clamping pairs of knives 60. The lower portion of clamp 64 is substantially thinner than the upper portion and this thin portion is flexible.

The front plate 56 of holder 51 has upper and lower rows of holes which receive upper set screws 62 which are threadedly received in plate 56 for engaging the thick portions of clamp 64 in the recess 65 of flange 66 for retaining the clamp 64 in the holder 51 and lower mounting screws 63 which pass through in the lower holes of plate 51 and are threadedly received in the clamp elements. With certain of screws 62 tightened, one clamp element of the clamp 64 is urged against the front surface of a certain pair of knives 60 in the knife holder 51, and with the other set screws 63 tightened another clamp element is urged against other knives 60. This urges the rear edge of knives 60 against the front surface of back place 53 for simultaneously clamping them in place in holder 51.

THE JIG 70

Figure 10:
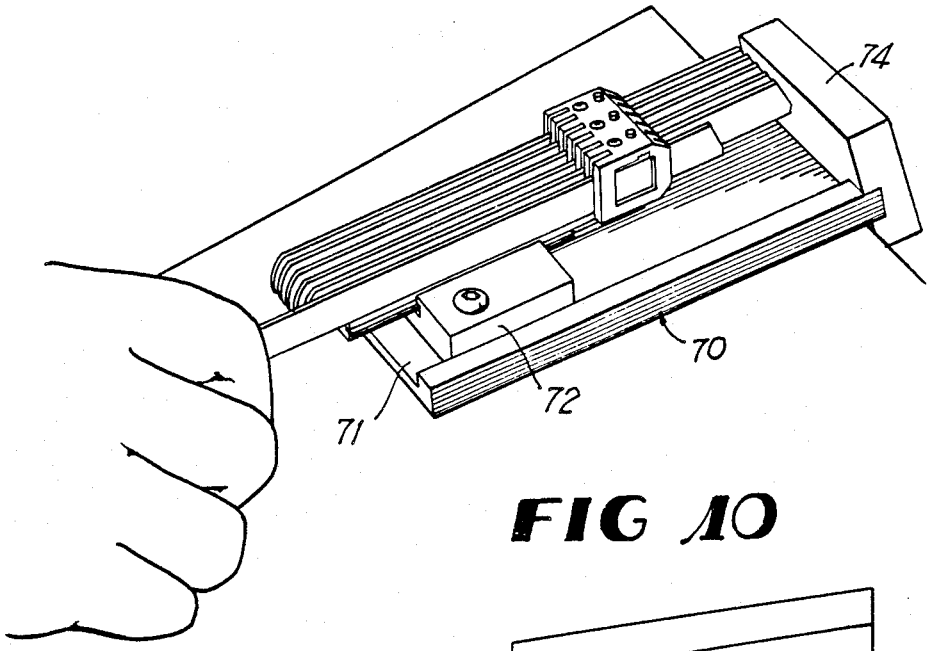
FIG. 10 is a perspective view of a knife holder assembly jig receiving the knife carrier and knives to be jigged.
Figure 11:
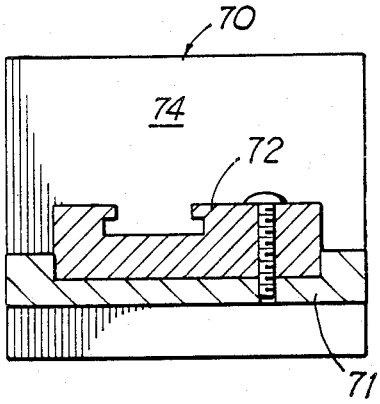
FIG. 11 is a vertical sectional view of the jig depicted in FIG. 10.
Figure 12:
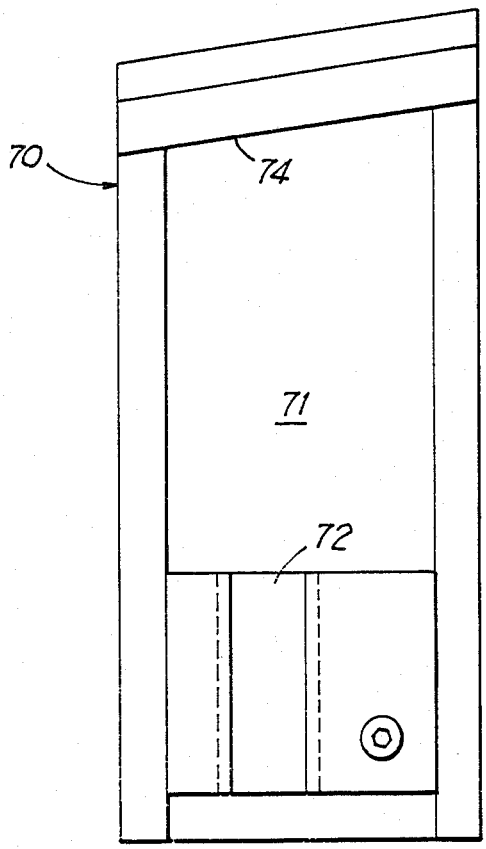
FIG. 12 is a top plan view of the jig of FIGS. 10 and 11.

For providing a ready means for setting the height of all knives 60 in the knife carrige which includes holder 51 and bracket 35, we have provided a jig 70 seen in FIGS. 10, 11 and 12. The jig 70 has a channel shaped bed or base 71 in which is a bracket cradle 72, recessed in the trough of base 71. This bracket 72 is fixed in place on base 71, being secured by bolts or machine screws 73.

The upper surface of cradle 72 has a bracket receiving slot 131, identical in shape to slot 31, except that the slot 131 is aligned with base 71.

At the forward end of the base 71 is a stop plate 74 extending transversely across the end at an acute angle of about 82° to the longitudinal axis of base 71 and the axis of slot 131. Stop plate 74 extends above and below the plane of the base 71.

In use, bracket 35 is inserted into the slot 131, until arresting pin 38 strikes the cradle 72, in the same manner in which it is inserted into slot 31. Then, set screw 41 is tightened to lock the bracket 35 in the cradle 72. Thereafter, the knives 60 are inserted into the slots 57 and 58 until the top cutting edge 60*a* of each knife 60 strikes the stop plate 74. Then the set screws 63 are tightened. Thus, the knife height of all knives 60 in a common angling plane and are "jigged" to these predetermined heights, thereby removing the necessary judgment and eliminating the possibility of knife height variation. No additional settings of the knives 60 are necessary and, when the knife carriage, i.e., the bracket 35, is removed from jig 70, it is ready to be installed in slot 31 in the tufting machine.

KNIFE TENSION TOOL 80

Figure 13:
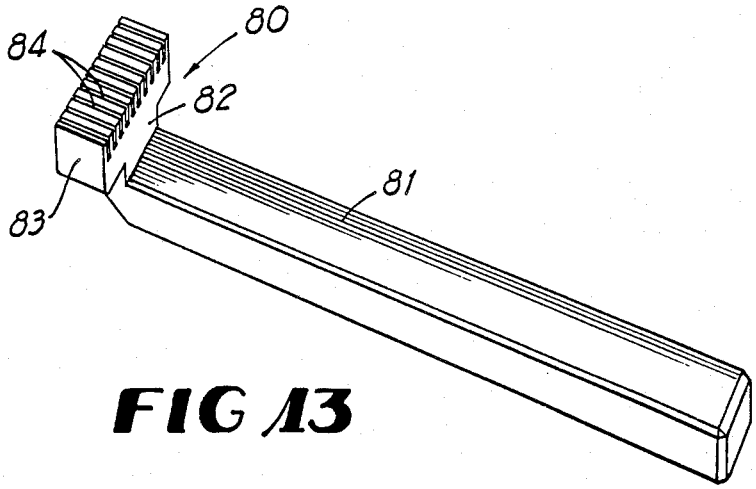
FIG. 13 is a perspective view of the knife tension tool.
Figure 14:
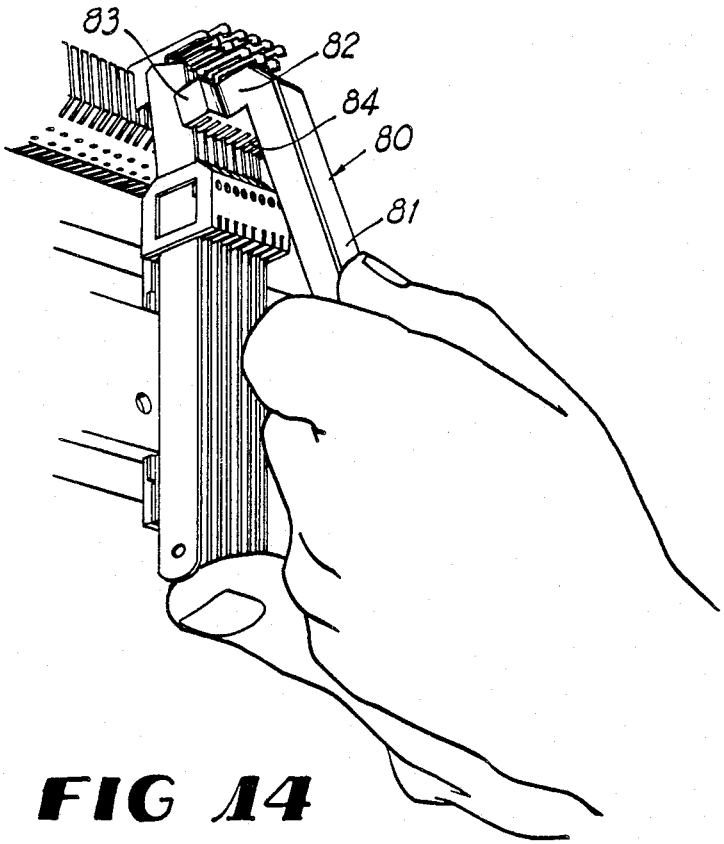
FIG. 14 is a perspective view of the tool of FIG. 13 in use tensioning the blades as they are installed.

In FIGS. 13 and 14 is illustrated the knife tension tool 80 which includes a straight handle 81, by which the tool 80 is grasped. Handle 81 has shank 82 angling sidewise from one end thereof. The end of shank 82 carries a transversly extending rectangular blade tensioning block 83, at its end. Block 83 has a plurality of parallel knife receiving, sidewise opening or slots 84, the spacing of which is equal to the spacing of the knife in a knife holder 51.

In use, the knife tension tool 80 is placed adjacent to the knives as the knife carriage is inserted upwardly in slot 31 so that the edges of the knives 60, between its cutting edge 60*a* and holder 51 are received in the respective slots 84. Then, as the bracket 35 is inserted still farther upwardly in a linear path, the tool 80 is manipulated to align the knives 60 for respectively entering the spaces between the loopers 22, the tension tool 80 being pivoted to flex the upper end portions of all knives 60 simultaneously away from the loopers 22 until they are appropriately in position. The tool 80 is then removed, releasing the knives 60 to a biased condition against the sides of loopers 22.

KNIFE HOLDER REMOVAL TOOL 90

Figure 15:
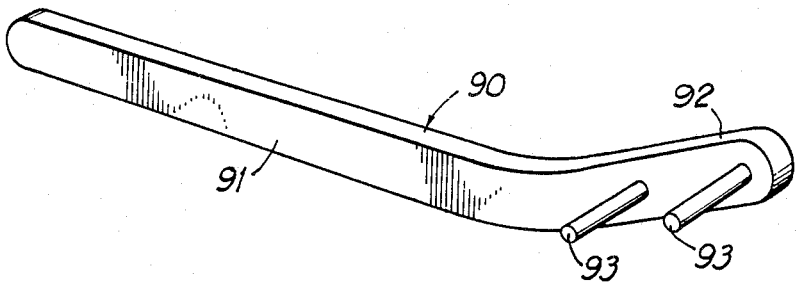
FIG. 15 is a perspective view of the knife holder removal tool.
Figure 16:
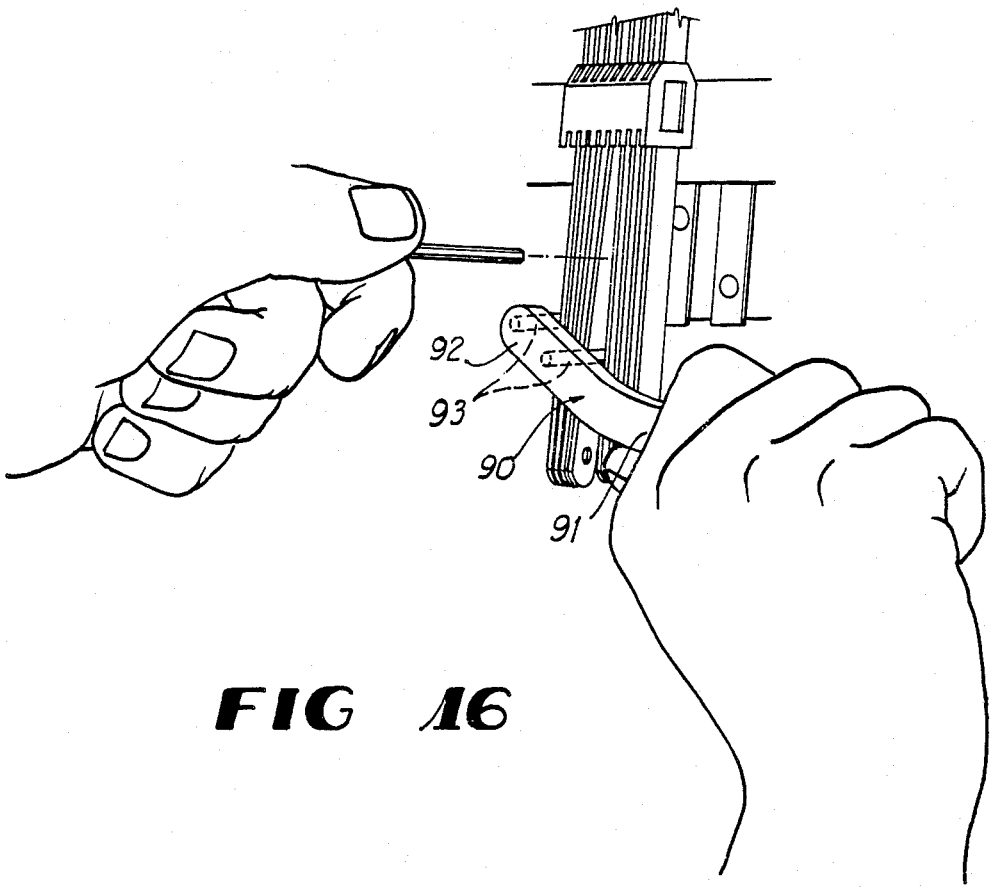
FIG. 16 is a perspective view of the knife holder removal tool of FIG. 15 in use with the installed knife holder assembly.

In FIGS. 15 and 16 is shown a knife holder removal tool 90 which has a handle 91 with an angled head 92 on the end of the handle 91, the handle 91 and angling head 92 being in a common plane. A pair of spaced parallel tines 93 protrude sidewise from the head 92 and perpendicular to the plane of the handle 91 and head 92. These tines 93 are cylindrical in shape and are spaced apart by a distance greater than the space between about four blades and less than the length of the portion of knife 60 below holder 51. The length of the tines is about the width of a knife 60 or slightly longer.

In use, the handle 91 is positioned so as to insert the tines 93 on opposite sides of a central knife 60 and an outer knife 60. By tilting the handle 90, the tines urge the bottom portions of these adjacent knives 60 apart, to permit the an Allen wrench to be inserted into the set screw 41.

SECOND EMBODIMENT OF KNIFE HOLDER ASSEMBLY

In FIGS. 6, 7, 8 and 9 is illustrated a second embodiment of the present invention. In this embodiment the bracket carrying block 125 and bracket 135 are substitued for the block 25 and bracket 35 of the first embodiment. In more detail, the block 25 has a plurality of equally spaced guide slots or slits 131*a* in place of slots or slits 31. Each slot or slit 131*a* is forwardly opening and also open at the top and bottom of block 125.

Each guide slit 131*a* is at an angle of from about 79° to about 85° to the horizontal axis of block 125 and preferable at 82°. The slit 131*a* is defined by spaced parallel opposed side surfaces and a straight back surface formed by the block 125. Adjacent to each guide slit 131*a* is a set screw 141 having a head 142. Set screw 141 is threadedly received in the block 125 with its head 142 spaced from the block 125.

The upstanding bracket 135 is made from rectangular bar stock and has a shim-like key or guide blade 132 pressed into a slot along the back surface on bracket 135, parallel to the axis of the bracket 135. Bracket 135, at its upper end receives the knife holder 151 which carries the knives 160. The holder 151 and knives 160 are identical to holder 51 and knife 60, the knives 160 being retained by clamp 164.

A screw 150 and pin 149 identical to screw 50 and pin 149 secure the holder 151 in place.

Bracket 135 has a longitudinal screw slot 140 in its lower portion. The slot 140 is parallel to guide blade 132 and is enlarged at its upper end to receive head 142. The remainder of slot 140 is slightly larger than the body of screw 141 but smaller than head 142 so that, by inserting the bracket 135 over the head 142 and then moving the bracket 135 upwardly until its movement is stopped by the arresting screw 141, the guide blade 132 slides in slot 131*a*, the knives 160, whose edges are parallel to the axis of bracket 135, are carried by knife holder 151 on the upper end of bracket 135 in a linear path into their appropriate positions.

THIRD EMBODIMENT

In FIGS. 6, 7, 8 and 9 is the third embodiment of our knife holder assembly which includes the carrying block 225, which replaces carrying block 25 on the support bar 20.

The front of block 225 is provided with upwardly angled, flat, transversely spaced, parallel, rectangular, shim-like blades or guides 232. Guides 232 are at between 79° and 95° and preferably to 82° to the horizontal axis of block 225. The block 225 is provided with spaced holes 226 respectively located between the guides 232, each hole 226 receiving a machine screw 241 therein. Each screw 241 has a head 242 which will pass through the wide portion of a longitudinal slot 240 in the lower portion of a rectangular bracket 235. A bolt or screw 250 passes through the upper end portion of the bracket 235 and secures the knife holder 251 in place. Knife holder 251 is identical to knife holder 50 and carries blades 260 clamped by a rectangular clamp 264. Pin 249 prevents rotation of holder 251.

The brackets, such as bracket 235, fit flush against the front of block 225 and are of a width to be slidably received snugly between adjacent pairs of guides 232. When moved to their uppermost positions on the bolts or screws, such as screw 241 and tightened, the brackets, such as bracket 235, hold knives 260 in appropriate positions for cutting action to cut the loops on their associated loopers.

It will be obvious to those skilled in the art that many variations may be made in the embodiments chosen for purposes of illustrating the invention, without departing from the scope of the invention as defined by the claims.

I claim:

1. A knife holder assembly, for a tufting machine of the type having loopers in spaced parallel relationships for engaging and holding loops of yarns sewn into a backing material and wherein a plurality of parallel elongated knives having cutting edges of their ends, are disposed with their cutting edges respectively in cutting engagement with the sides of said loopers the body portions of said knives being disposed below said loopers and wherein a support means below said loopers is reciprocated for imparting cutting motion to said knives, comprising:

(a) a moveable knife carriage for removeably receiving and holding said knives in prescribed positions therein and so that the portions of said knives which contain the cutting edges protrude in the same direction from said knife carriage;

(b) a carrying member for being mounted on said support means for movement therewith, said carrying member having surface portion for receiving a portion of said knife carriage thereon;

(c) guide means for defining a prescribed generally upright path of travel for said knife carriage along which said knife carriage is moveable upwardly and downwardly toward and away from said loopers;

(d) means for confining said knife carriage within said path during a portion of its travel along said path;

(e) said surface of said carrying member and said guide means and said means for confusingly said knife carriage within said path cooperating to permit said knife carriage to be progressively move upwardly for carrying said plurality of said knives from a position in which the cutting edges of said knives are below and spaced form said loopers; and (f) detent means for releasably locking said knife carriage in a position in said path in which said knife carriage holds;

(g) said cutting edges in their cutting engagement positions, said detent means when released, permitting said knife carriage to be moved progressively downwardly within said path for simultaneously withdrawing said knives progressively downward from said loopers until said knife carriage is no longer confined in said path.

2. The knife holder assembly defined in claim 1 wherein said guide means includes a straight and a cooperating, one of said surfaces being on said carrying member and the other of said surfaces being on the said knife carriage, said surfaces cooperating to define said path of travel for said knife carriage and said knives so that said knife carriage can be moved along said path from a starting position which said cutting edges of said knives are spaced from said loopers to said prescribed position in which ends of said knives are inserted into the spaces between said loopers and said cutting edges are respectively in cutting engagement with said loopers.

3. The knife holder assembly defined in claim 1 in which said path of travel is at an acute angle to the horizontal.

4. The knife holder assembly defined in claim 3 wherein said acute angle is between about 79° and 85°.

5. The knife holder assembly defined in claim 1 including an arresting means on said knife carrier for engagement with said carrying member when said knife carrier is in a position on said carrying member in which said cutting edges of said knives are in their cutting positions.

6. A knife holder assembly comprising:

(a) a carrying member for being mounted in a transversely extending position on a portion of a path of travel adjacent to a plurality of loopers on said tufting machine;

(b) a knife carriage for being removably mounted in a prescribed positon on said carrying member;

(c) guide means for guiding said knife carriage at a prescribed angle to said carrying member into a presecribed position on said carrying member;

(d) detent means for releasably locking said knife carriage on said carrying member when said knife carriage is in said prescribed position; and (e) a plurality of parallel knives received by said knife carriage, said knives protruding away from said knife carriage and having cutting edges at their ends for cooperating with said loopers for severing loops of yarn held by said loopers; and (f) said carrier including a bracket and knife holder on said knife carriage, said carrying member being a bar having an outer surface and top and bottom surfaces, said carrying member being provided with a slot extending from the bottom surface and defining therebetween a front opening for said slot, said bracket, when it is to be mounted on said carrying member, being insertable into said slot at the bottom of said member and having means engageable with said flanges for arresting outward movement of said bracket when said bracket is in said slot, whereby said bracket can be moved in said slot for simultaneously moving said bracket, said knife holder and said knives toward said loopers so that the end portion of said knives are moved into spaces between said loopers and so that said cutting edges are positioned for cutting engagement when said knife carriage has been moved to its prescribed position in said slot.

7. A knife holder assembly comprising:

(a) a carrying member for being mounted in a transversely extending position on a portion of a tufting machine for reciprocation by said portion along a path of travel adjacent to a plurality of loopers on said turfing machine;

(b) a knife carriage for being removably mounted in a prescribed position on said carrying member;

(c) guide means for guiding said knife carriage at a prescribed angle to said carrying member into a prescribed position on said carrying member;

(d) detent means for releasably locking said knife carriage on said carrying member when said knife carriage is in said prescribed position; and (e) a plurality of parallel knives received by said knife carriage, said knives protruding away from said knife carriage and having cutting edges at their ends for cooperating with said loopers for severing loops of yarn held by said loopers; and (f) said carrying member having a straight slot disposed at an acute angle to said member and said guide means being a guide element extending from said carrier into said slot.

8. The knife holder assembly defined in claim 7 wherein said carrier is provided with a longitudinal slot and wherein said detent means is a screw threadedly received by said carrying member, said screw protruding through said longitudinal slot, said longitudinal slot being parallel to said slot in said carrying member for permitting movement of said carrier along a path, prescribed by the slots, toward and away from said loopers when said screw is loosened.

9. A knife holder assembly comprising:

(a) a carrying member for being mounted in a transversely extending position on a portion of a tufting machine for reciprocation by said portion along a path of travel adjacent to a plurality of loopers on said tufting machine;

(b) a knife carriage for being removably mounted in a prescribed position on said carrying member;

(c) guide means for guiding said knife carriage at a prescribed angle to said carrying member into a prescribed position on said carrying member;

(d) detent means for releasably locking said knife carriage on said carrying member when said knife carriage is in said prescribed position; and (e) a plurality of parallel knives received by said knife carriage, said knives protruding away from said knife carriage and having cutting edges at their ends for cooperating with said loopers for severing loops of yarn held by said loopers; and (f) said guide means including a pair of straight opposed parallel guides extending angularly from said carrier member, said detent means including means for slidably retaining said bracket for linear movement in the space between said guides.

10. A knife holder assembly comprising:

(a) a mounting bracket carrying member for being mounted in a tranversely extending position on a portion of a tufting machine for reciprocation by said portion along a path of travel adjacent to a plurality of loopers on said tufting machine;

(b) a knife carriage for being removably mounted in a prescribed position on said carrying member;

(c) guide means for guiding said knife carriage at a prescribed angle to said carrying member into a prescribed position on said carrying member;

(d) detent means for releasably locking said knife carriage on said carrying member when said knife carrier is in said prescribed position; and (e) a plurality of parallel knives received by said knife carriage, said knives protruding away from said knife carriage and having cutting edges at their ends for cooperating with said loopers for severing loops of yarn held by said loopers; and (f) the carrier including a bracket for being received by said carrying member and a knife holder on the end of said bracket and extending beyond said carrying member when said bracket is in it prescribed position, said knife holder extending sidewise from said bracket, said knives being held by their intermediate portions in said knife holder and protruding generally in the same direction as said bracket, and away from said end of said bracket, said knives extending toward said loopers, said guide means guiding said bracket so that, as said bracket is moved on said member, it moves in a linear path for moving the knives toward and away from said loopers.

11. The knife holder assembly defined in claim 10 including means for simultaneously flexing said portions of said knives adjacent to said loopers as the knives are inserted toward said loopers and for thereafter releasing said knives.

12. A knife holder assembly comprising:

(a) a carrying member for being mounted in a transversely extending position on a portion of a tufting machine for reciprocation by said portion along a path of travel adjacent to a plurality of loopers on said tufting machine;

(b) a knife carriage for being removably mounted in a prescribed position on said carrying member;

(c) guide means for guiding said knife carriage at a prescribed angle to said carrying member into a prescribed position on said carrying member;

(d) detent means for releasably locking said knife carriage on said carrying member when said knife carrier is in said prescribed position; and (e) a plurality of parallel knives received by said knife carriage, said knives protruding away from said knife carriage and having cutting edges at their ends for cooperating with said loopers for severing loops of yarn held by said loopers; and (f) means for simultaneously engaging portions of said knives for flexing the knives to provide a space between knives for access to the detent.

* * * * *

UNITED STATES PATENT AND TRADEMARK OFFICE

CERTIFICATE OF CORRECTION

PATENT NO. : 4,608,934

DATED : September 2, 1986

INVENTOR(S) : Roy T. Card and Joseph L. Card

It is certified that error appears in the above-indentified patent and that said Letters Patent is hereby corrected as shown below:

In the drawings, sheet 1, FIG. 2, reference numeral 23 should be applied to the block element attached to loopers 22.

In the drawings, sheet 5, FIG. 10, reference numeral 131 should be applied to the t-shaped slot formed in cradle element 72.

In the drawings, sheet 5, FIG. 11, reference numeral 131 should be applied to the t-shaped slot formed in cradle element 72.

In the drawings, sheet 5, FIG. 12, reference numeral 131 should be applied to the t-shaped slot formed in cradle element 72.

In the drawings, sheet 6, FIG. 14, reference numeral 51 should be applied to the box holder for the knives.

In the drawings, sheet 6, FIG. 14, reference numeral 60 should be applied to the knives.

In the drawings, sheet 6, FIG. 14, reference numeral 60a should be applied to the cutting edge of the knives facing towards the tool 80.

In the drawings, sheet 6, FIG. 14, reference numeral 22 should be applied to the loopers positioned above the upper ends of the knives 60.

Column 1, line 61, change "brackets" to --bracket--;
Column 4, line 39, change "FIG. 1" to --FIG. 2--;
Column 4, line 67, after "25" insert --(FIG. 1)--;
Column 5, line 36, change "lugs 35" to --lugs 37--;
Column 5, line 63, after "thus" insert --is--;
Column 5, line 68, change "42" to --(not shown)--;
Column 6, line 4, change "rectangualr" to --rectangular--;
Column 6, line 5, delete "is";
Column 6, line 20, after "22" insert --(FIG. 2)--;
Column 6, line 21, after "edge" insert --knife--;

UNITED STATES PATENT AND TRADEMARK OFFICE

CERTIFICATE OF CORRECTION

PATENT NO. : 4,608,934

DATED : September 2, 1986

INVENTOR(S) : Roy T. Card and Joseph L. Card

Figure 4:
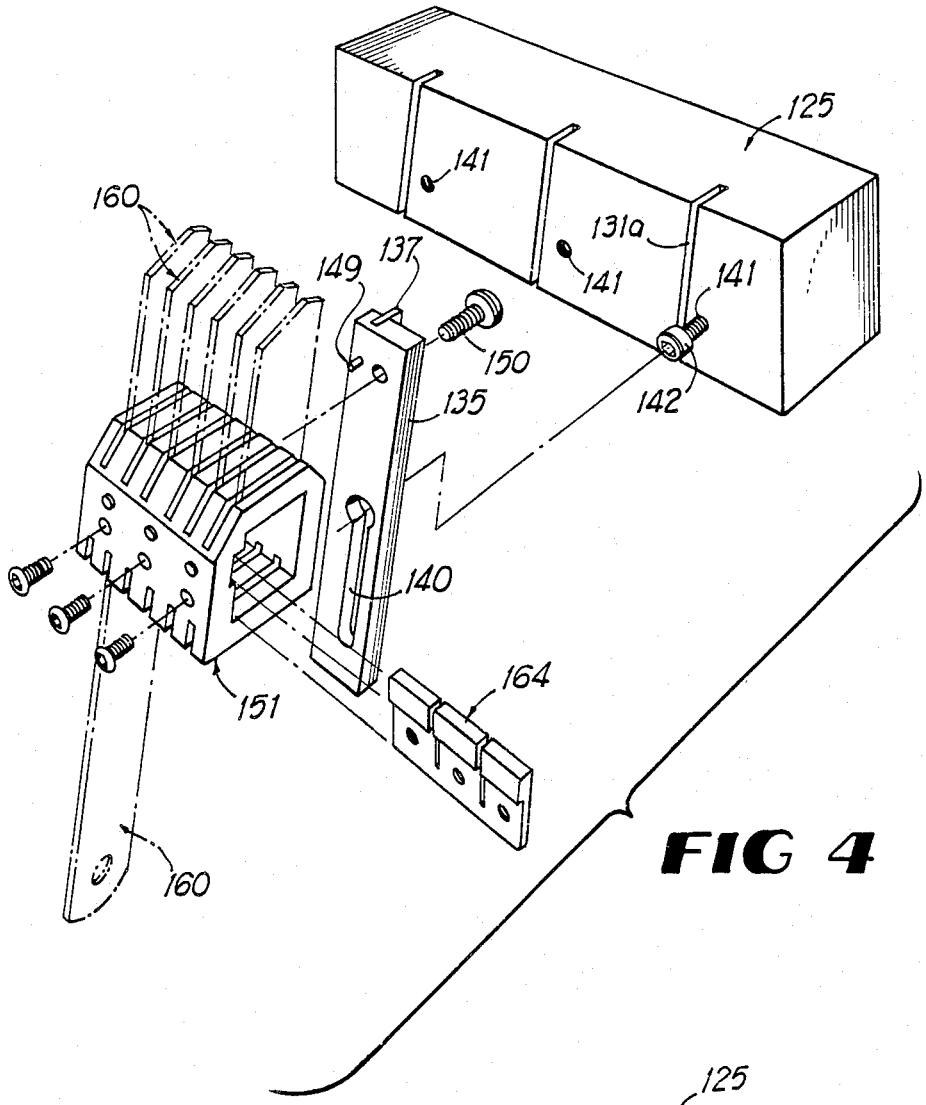
FIG. 4 is an exploded perspective view of a second embodiment of the knife holder assembly of the present invention.
Figure 5:
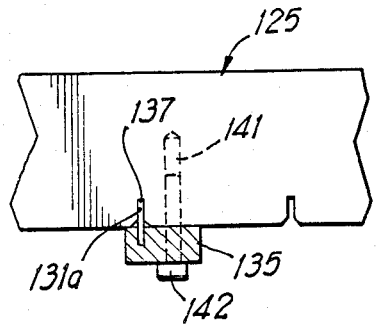
FIG. 5 is a cross-sectional view of the knife holder depected in FIG. 4.
Figure 6:
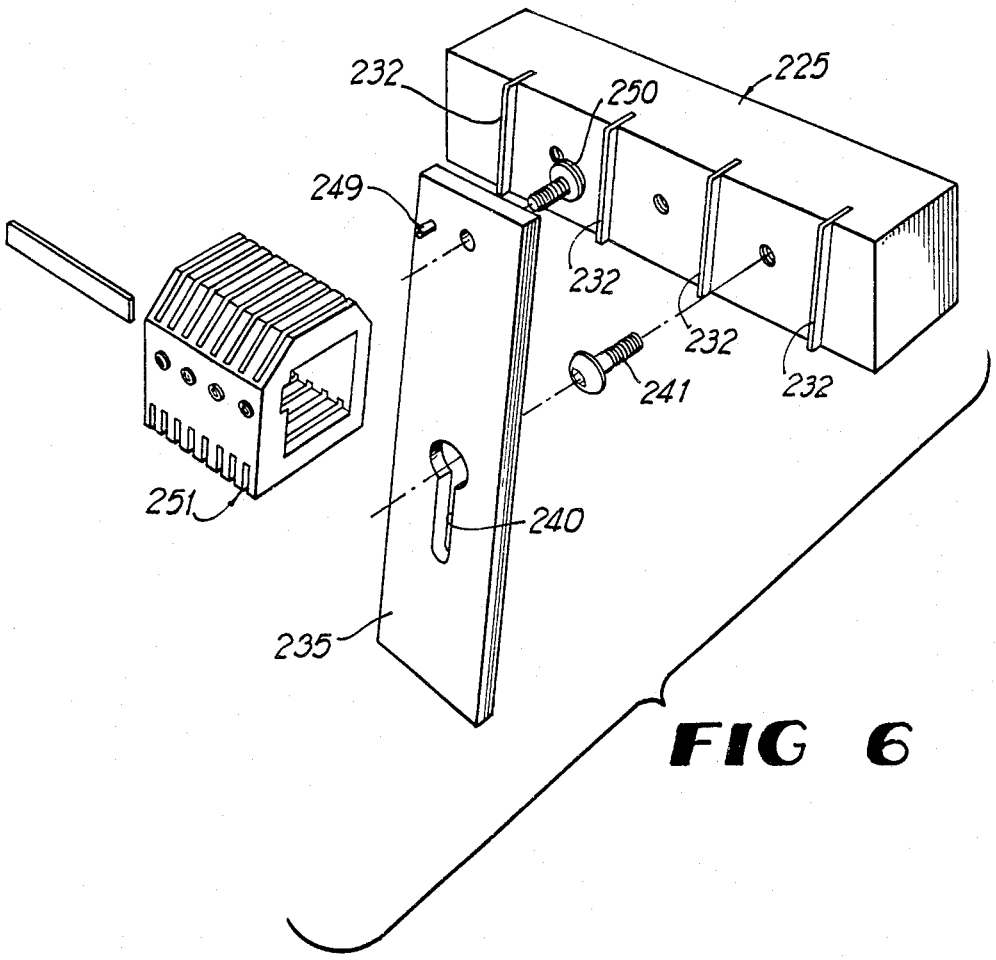
FIG. 6 is an exploded perspective view of a third embodiment of the knife holder assembly of the present invention.
Figure 7:
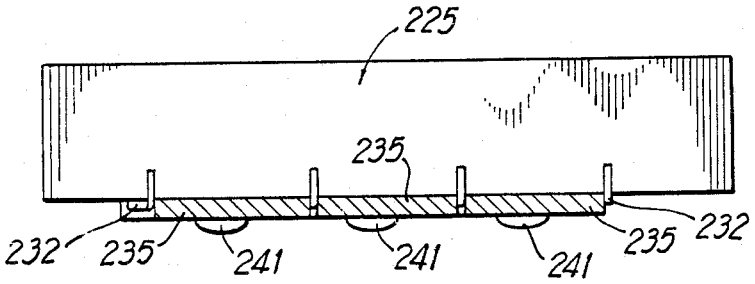
FIG. 7 is a cross sectional view of a portion of the knife holder assembly depicted in FIG. 6.
Figure 9:
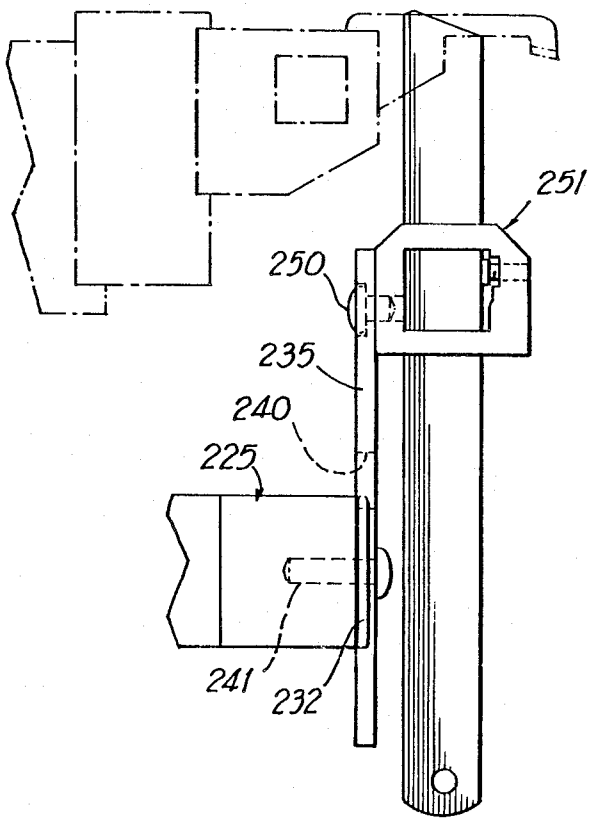
FIG. 9 is a side elevational view of the knife holder assembly of FIGS. 6, 7 and 8, the tufting machine and loopers being shown in broken lines.
Figure 8:
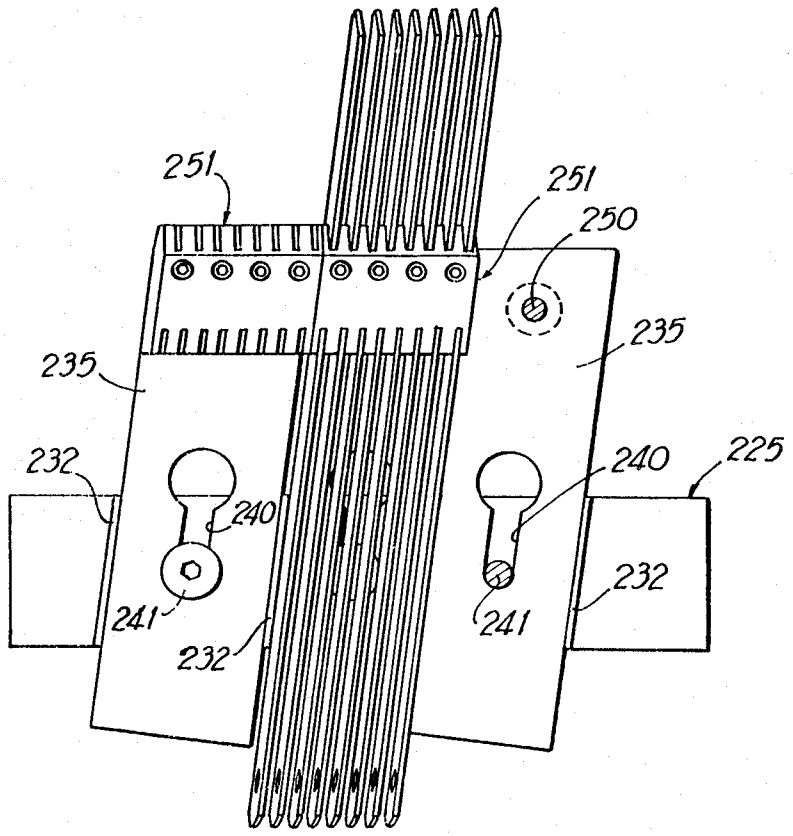
FIG. 8 is a partially broken away, front elevational view of the knife holder assembly of FIG. 7, with three knife carriers installed, side-by-side on a common carrying member.

It is certified that error appears in the above-indentified patent and that said Letters Patent is hereby corrected as shown below:

Column 6, line 24, after "57" insert --(FIG. 1)--;
Column 6, line 35, change "57" to --58--; and change "58" to --57--;
Column 6, line 49, change "place" to --plate--;
Column 7, line 12, delete "73";
Column 7, lines 34-35, change "in the tufting machine" to --(FIG. 1) of the knife assembly--;
Column 8, line 14, change "FIGS. 6, 7, 8, and 9" to --FIGS. 4 and 5--;
Column 8, line 18, change "25" to --125--;
Column 8, line 31, change "132" to --137--;
Column 8, line 38, delete "and pin 149";
Column 8, line 41, change "132" to --137--;
Column 8, line 47, change "132" to --137--;
Column 8, line 61, change "95°" to --85°--;
Column 9, line 3, delete "260";
Column 9, line 4, delete "264";
Column 9, line 10, delete "260";
Column 9, line 22, change "of" to --at--;
Column 9, line 36, after "having" insert --a--;
Column 9, line 45, after "surface" insert --portion--;
Column 9, line 46, change "confusingly" to --confining--;
Column 9, line 48, change "move" to --moved--;
Column 9, line 51, change "form" to --from--;
Column 9, line 54, change ";" to --,--;
Column 9, line 55, delete "(g)";
Column 9, line 63, after "straight" insert --surface--,
Column 9, line 64, after "cooperating" insert --surface--;
Column 10, line 1, after "position" insert --in--;
Column 10, line 20, after the second recitation of "a" insert --tufting machine for reciprocation by said portion along a--;

UNITED STATES PATENT AND TRADEMARK OFFICE

CERTIFICATE OF CORRECTION

PATENT NO. : 4,608,934

DATED : September 2, 1986

INVENTOR(S) : Roy T. Card and Joseph L. Card

It is certified that error appears in the above-indentified patent and that said Letters Patent is hereby corrected as shown below:

Column 10, line 30, delete "and";
Column 10, line 36, change "carrier" to --knife carriage--;
Column 10, line 45, change "flanges" to --guide means--;
Column 10, line 50, change "portion" to --portions--;
Column 10, last line, delete "and";
Column 11, line 9, change "carrier" to --knife carriage--;
Column 11, line 11, change "carrier" to --knife carriage--;
Column 11, line 16, change "carrier" to --knife carriage--;
Column 11, line 32, delete "and";
Column 11, line 40, change "carrier" to --carrying--;
Column 12, line 6, change "carrier" to --knife carriage--;
Column 12, line 6, delete "and";
Column 12, line 12, change "carrier" to --knife carriage--;
Column 12, line 15, change "it" to --its--;
Column 12, line 44, delete "and";

UNITED STATES PATENT AND TRADEMARK OFFICE

CERTIFICATE OF CORRECTION

PATENT NO. : 4,608,934

DATED : September 2, 1986

INVENTOR(S) : Roy T. Card, et al

It is certified that error appears in the above-indentified patent and that said Letters Patent is hereby corrected as shown below:

Column 12, line 52, after "detent" insert --means--.

Signed and Sealed this

Twenty-ninth Day of November, 1994

*Attest:*

Bruce Lehman

BRUCE LEHMAN

*Attesting Officer*

*Commissioner of Patents and Trademarks*